US005681230A

United States Patent [19]

Krings

[11] Patent Number: 5,681,230

[45] Date of Patent: Oct. 28, 1997

[54] AUTOMATIC BASKETBALL RETURN APPARATUS

[76] Inventor: Harold F. Krings, 3058 - 38th Ave., Columbus, Nebr. 68601

[21] Appl. No.: 767,669

[22] Filed: Dec. 17, 1996

[51] Int. Cl.[6] ..... A63B 69/00; F41B 7/00

[52] U.S. Cl. ..... 473/433; 124/26

[58] Field of Search ..... 473/433; 124/26

[56] References Cited

U.S. PATENT DOCUMENTS

| | | | |
|---|---|---|---|
| 4,579,100 | 4/1986 | Whitaker | 124/26 |
| 4,667,957 | 5/1987 | Joseph | 473/433 |
| 4,714,069 | 12/1987 | Ulrich | 124/26 |
| 4,721,091 | 1/1988 | Ridley et al. | 124/26 |
| 4,896,882 | 1/1990 | Coleman | 473/433 |
| 4,915,380 | 4/1990 | Ackerman | 479/433 |
| 4,936,577 | 6/1990 | Kingston et al. | 473/433 |
| 5,273,275 | 12/1993 | Wilkerson | 473/433 |
| 5,447,144 | 9/1995 | Ivy | 124/26 |
| 5,540,428 | 7/1996 | Joseph | 473/433 |

*Primary Examiner*—William H. Grieb
*Attorney, Agent, or Firm*—Zarley, McKee, Thomte Voorhees & Sease; Mark D. Frederiksen

[57] ABSTRACT

An automatic ball return apparatus includes a ball retrieval net with a chute at the lower end for receiving an directing a ball to a ball return mechanism. The ball return mechanism includes a frame with guide rails for directing a ball forwardly out of the mechanism, and an ejector mechanism for launching the ball. The ejector mechanism includes an ejector arm connected to a motor which cycles the arm between a cocked position and a launch position, to selectively launch a ball received from the ball retrieval apparatus. A switch located between the guide rails is activated by a ball dropping onto the ball return mechanism, which operates the motor to eject the ball from the mechanism. The ball return mechanism is supported on a stand, and a motor with a drive shaft is mounted to a platform on the stand to selectively rotate the ball return mechanism on the stand. A transmitter is provided for signaling a receiver in a control unit connected to the motor on the stand, to thereby selectively rotate the ball return mechanism either clockwise or counterclockwise. The ball return mechanism is pivotally mounted on a supposed frame, with an adjustment arm extending between the mechanism in the frame permitting adjustment of the angle of elevation of the ball return mechanism relative to the horizontal.

20 Claims, 6 Drawing Sheets

AUTOMATIC BASKETBALL RETURN APPARATUS

TECHNICAL FIELD

The present invention relates generally to apparatus for returning a basketball to a shooter, and more particularly to an improved ball retrieval apparatus which automatically returns a ball to a shooter that is moving about a basketball court.

BACKGROUND OF THE INVENTION

There are a variety of prior art devices used for the retrieval of basketballs from the area of the hoop and backboard on a conventional basketball court, and returning them to a specific location on the basketball court. However, these prior art devices suffer several problems.

First, prior art mechanisms typically return the ball to one specific location, forcing the shooter to return to a specific location after shooting a shot.

Another problem with prior art basketball retrieval apparatus is in the complexity of set up and use of the apparatus. Typically, a great amount of time and labor is required to assemble the apparatus and then position the apparatus about the basketball hoop and backboard for use.

Still another problem of prior art ball retrieval apparatus is in the frequency of returning a ball from the apparatus. In many cases, the use of multiple shooters and multiple balls will cause jams or other problems in prior art ball retrieval apparatus.

In addition, many prior art devices rely on gravity to return the ball, thereby limiting the distance to which a ball may be returned.

SUMMARY OF THE INVENTION

It is therefore a general object of the present invention to provide an improved ball return apparatus.

A further object is to provide an improved ball return apparatus which may be automatically adjusted to follow a shooter about the basketball court.

Still another object of the present invention is to provide an improved ball retrieval apparatus which is capable of returning multiple balls with quick recycle times.

Yet another object is to provide a ball retrieval apparatus which is simple to set up and utilize at a particular site.

Yet a further object is to provide a ball return apparatus which may be adjusted to vary velocity, elevation and distance.

Still another object of the present invention is to provide a ball retrieval apparatus which is economical to manufacture and refined in appearance.

These and other objects of the present invention will be apparent to those skilled in the art.

The automatic ball return apparatus of the present invention includes a ball retrieval net with a chute at the lower end for receiving an directing a ball to a ball return mechanism. The ball return mechanism includes a frame with guide rails for directing a ball forwardly out of the mechanism, and an ejector mechanism for launching the ball. The ejector mechanism includes an ejector arm connected to a motor which cycles the arm between a cocked position and a launch position, to selectively launch a ball received from the ball retrieval apparatus. A switch located between the guide rails is activated by a ball dropping onto the ball return mechanism, which operates the motor to eject the ball from the mechanism. The ball return mechanism is supported on a stand, and a motor with a drive shaft is mounted to a platform on the stand to selectively rotate the ball return mechanism on the stand. A transmitter is provided for signaling a receiver in a control unit connected to the motor on the stand, to thereby selectively rotate the ball return mechanism either clockwise or counterclockwise. The ball return mechanism is pivotally mounted on a support frame, with an adjustment arm extending between the mechanism in the frame permitting adjustment of the angle of elevation of the ball return mechanism relative to the horizontal.

DESCRIPTION OF THE PREFERRED EMBODIMENT

Figure 1:
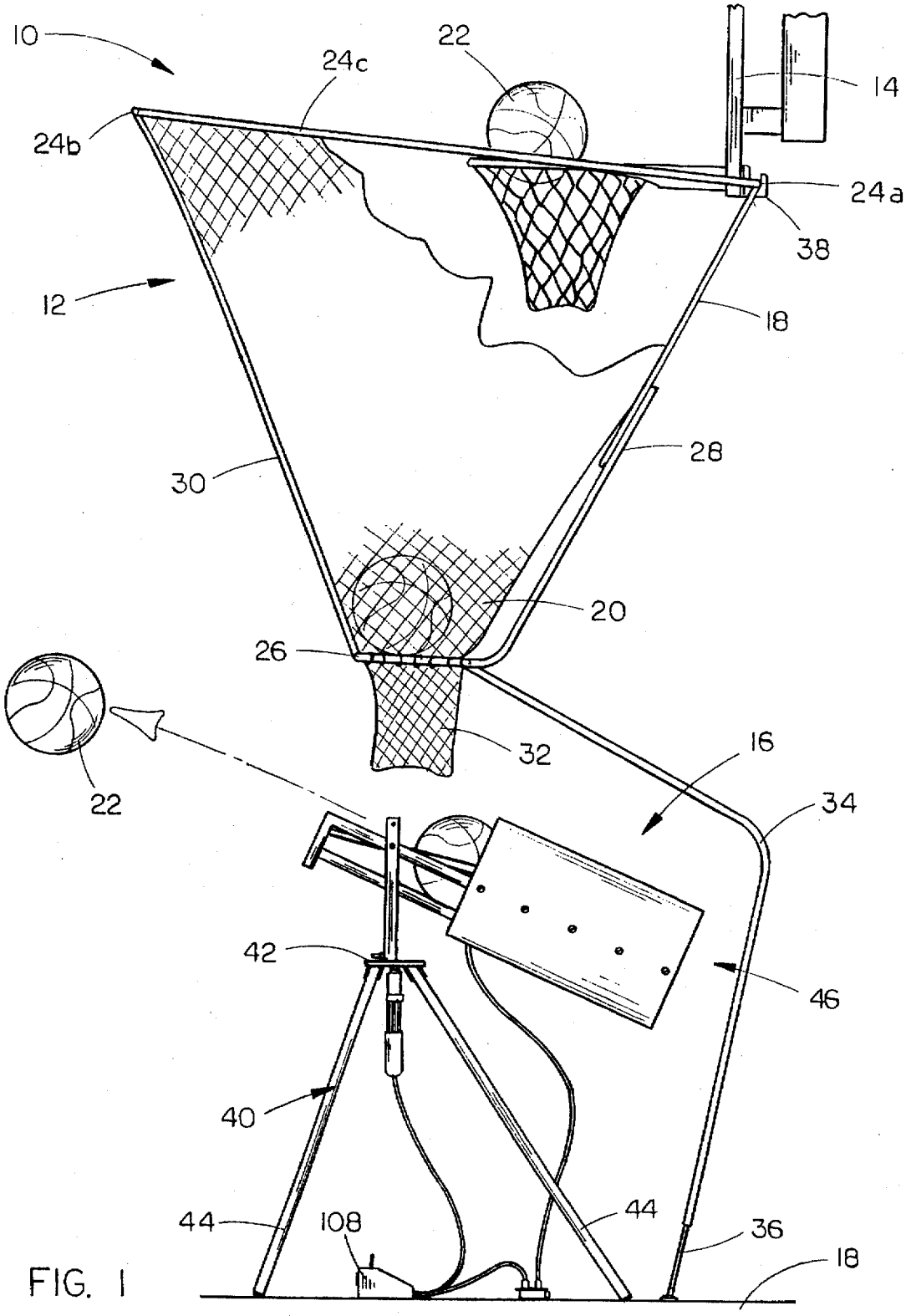
FIG. 1 is a side elevational view of the automatic ball return apparatus of the present invention.

Referring now to the drawings, in which similar or corresponding parts are identified with the same reference numeral and more particularly to FIG. 1, the automatic ball return apparatus of the present invention is designated generally at 10 and includes a retrieval net 12 connected to a basketball backboard 14, and a return mechanism 16 supported on the floor 18 directly below the retrieval net 12.

Figure 2:
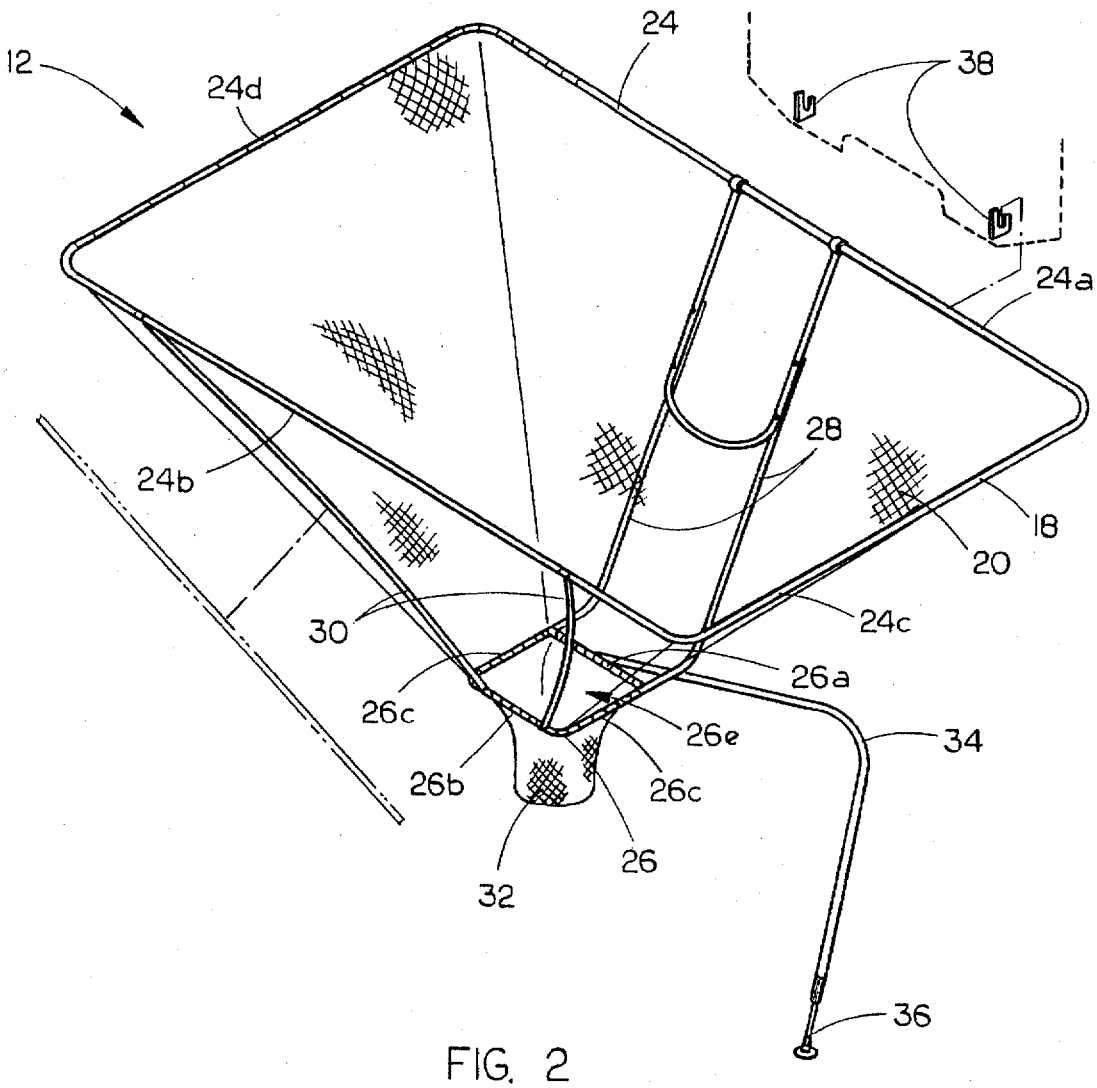
FIG. 2 is a perspective view of the retrieval net of the ball return apparatus.
Figure 3:
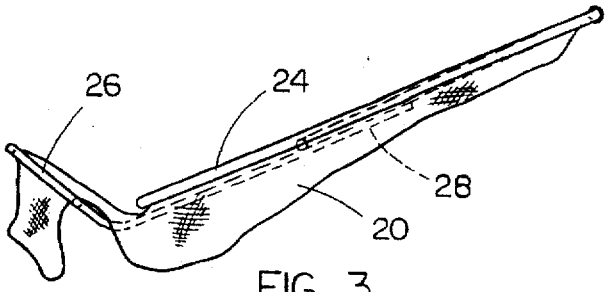
FIG. 3 is a side elevational view of the retrieval net of FIG. 3, moved to a collapsed position.
Figure 4:
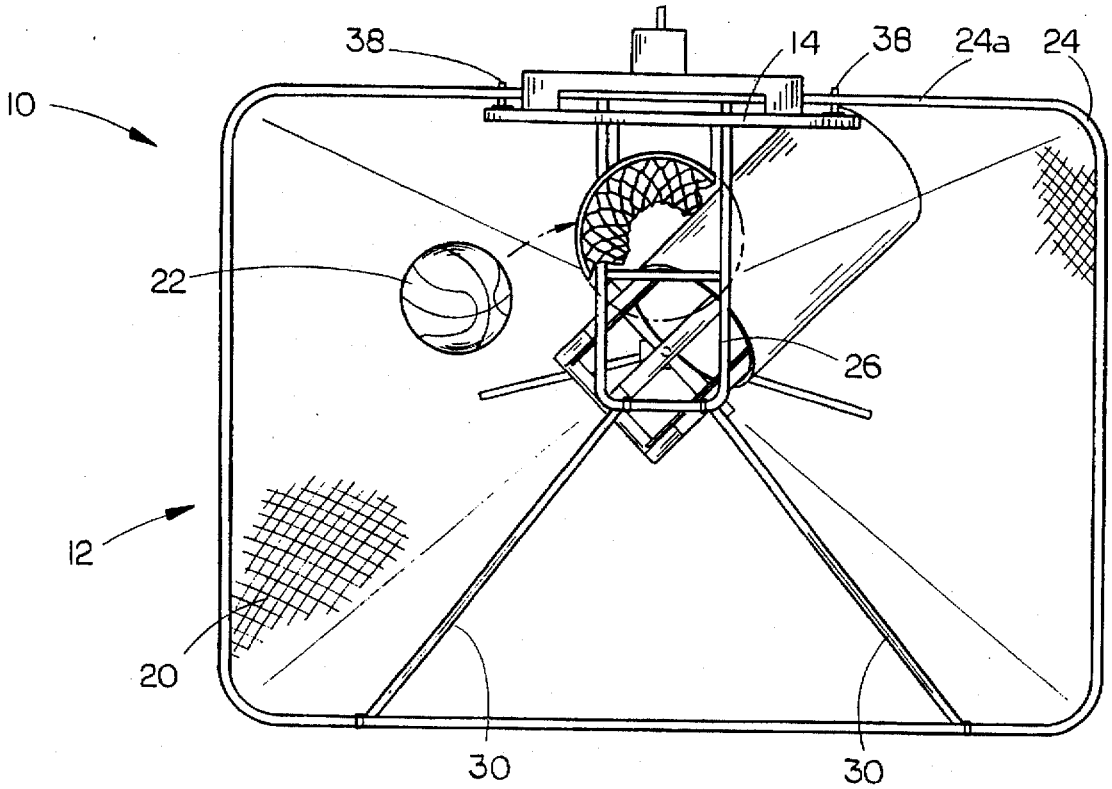
FIG. 4 is a top plan view of the ball return apparatus.
Figure 5:
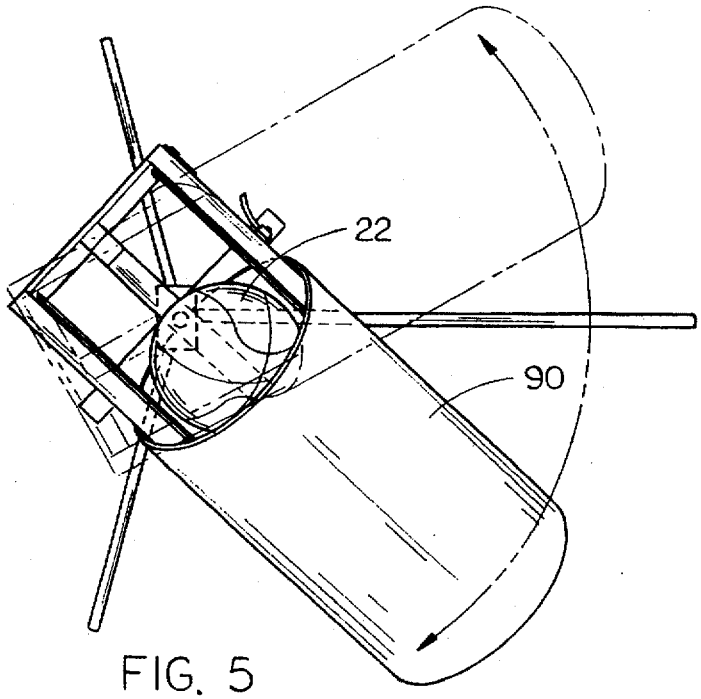
FIG. 5 is a top plan view of the return mechanism of the ball return apparatus.

Referring now to FIGS. 1 and 2, retrieval net 12 includes a collapsible support frame 18 having netting 20 connected thereto to direct a ball 22 to return mechanism 16. Support frame 18 includes a generally rectangular upper tubular frame 24 having a pair of longitudinal members **24*a* and 24*b*, and a pair of transverse members 24*c* and 24*d*. Preferably, both longitudinal members 24*a* and 24*b*, and transverse members 24*c* and 24*d* are telescopically collapsible, to permit easy and effective storage of retrieval net 12**.

A lower rectangular tubular frame 26 is located vertically below upper frame 24, and has longitudinal and transverse members **26*a*, 26*b*, 26*c*, and 26*d* with lengths shorter than those of the upper frame members, thereby forming a smaller opening 26*e*** therethrough.

A pair of vertical support rods 28 extend between upper frame 24 and lower frame 26 to vertically separate the frames and hold netting 20 taut. Preferably, support rods 28 are telescopic, to permit collapsing of retrieval net 12. A pair of auxiliary support rods 30 are removably secured between upper frame longitudinal member **24*b* and lower frame longitudinal member 26*b*, opposite support rods 28. Netting 20 is attached along the periphery of upper frame 24 and lower frame 26 to form a generally funnel shape when support rods 28 and 30** hold the net taut.

A chute 32 formed of netting 20 hangs from lower frame 26 and depends to a circular shape, to slow the speed of a falling ball through the retrieval net, and thereby more accurately drop the ball onto return mechanism 16 (as shown in FIG. 1 ).

A support post 34 has an upper end removably connected to lower frame 26 and a lower end supported on the floor 18. A foot 36 on the lower end of post 34 is vertically adjustable to orient the lower end of retrieval net 12 relative to backboard 14. A pair of hook-shaped brackets 38 are mounted on backboard 14 to removably receive upper frame longitudinal member 24*a* thereon. In this way, post 34 may be adjusted to pivot retrieval net 12 about upper frame longitudinal member 24*a* in brackets 38.

Referring once again to FIG. 1, the return mechanism 16 includes a tripod type support stand 40 with a platform 42 supported on legs 44. An ejector apparatus 46 is rotatably mounted to support stand 40, as described hereinbelow, and ejects balls 22 back to a shooter.

Figure 6:
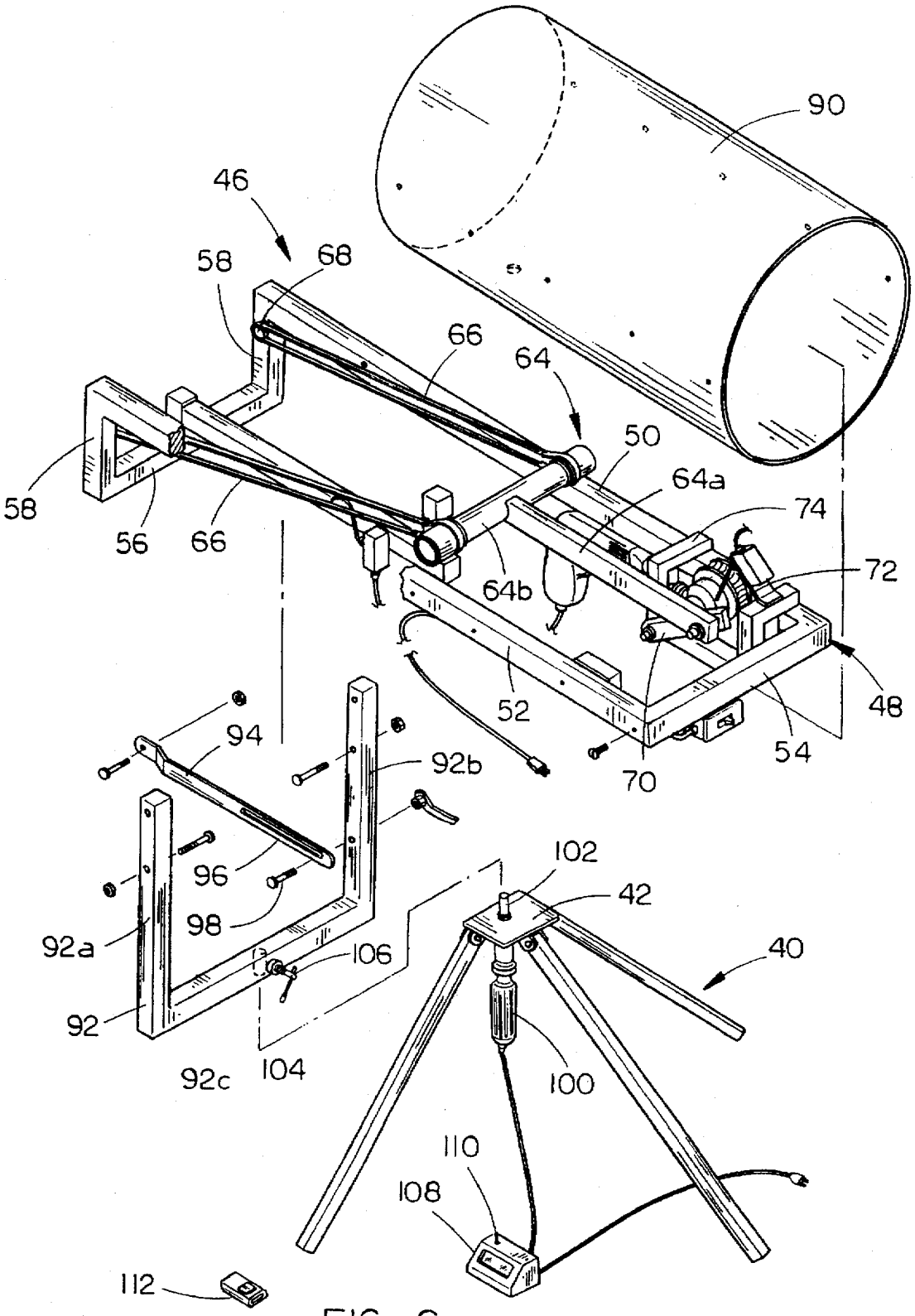
FIG. 6 is an exploded perspective view of the return mechanism of the ball return apparatus.
Figure 7:
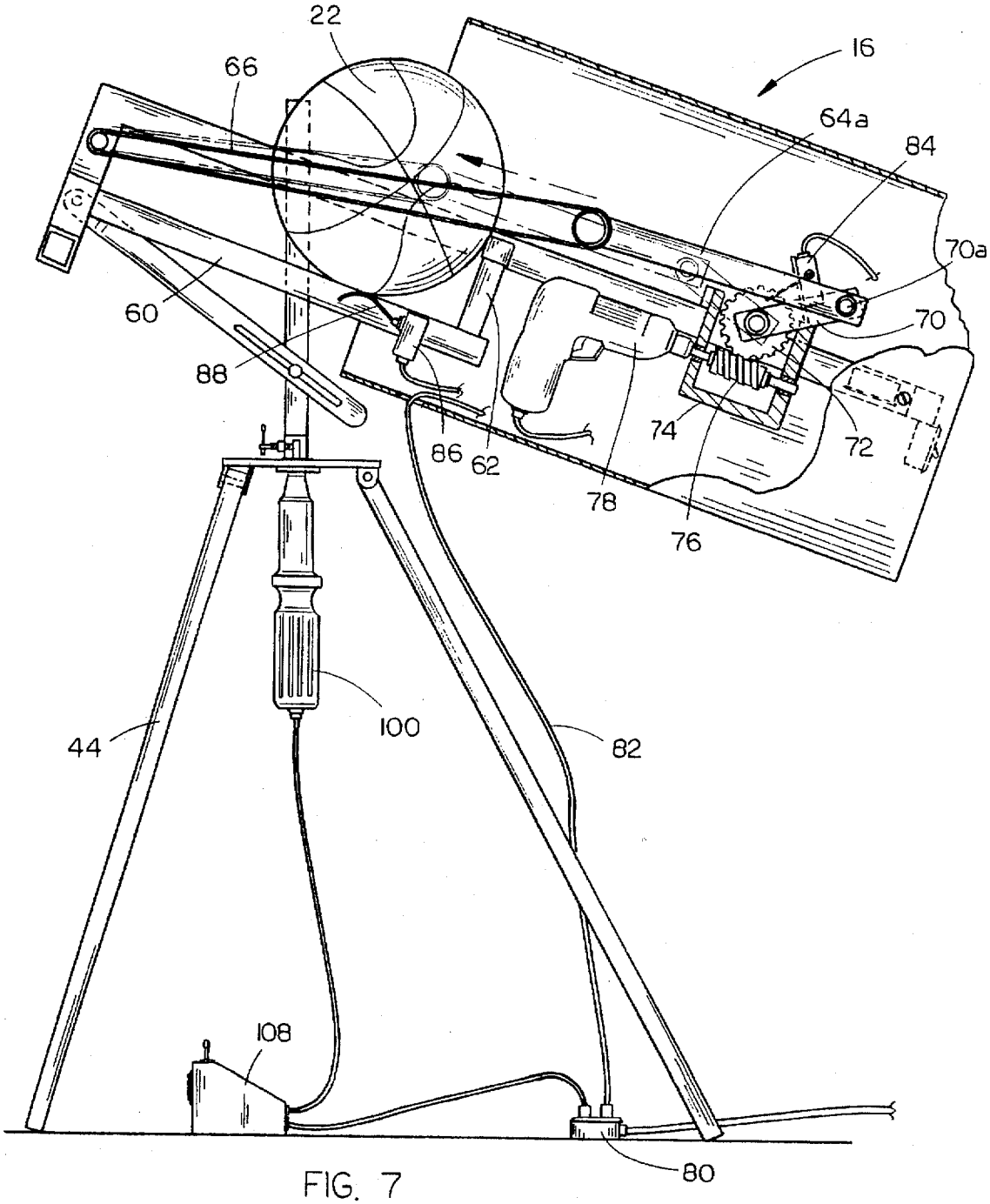
FIG. 7 is a side elevational view of the return mechanism, with portions thereof shown in sectional view.
Figure 8:
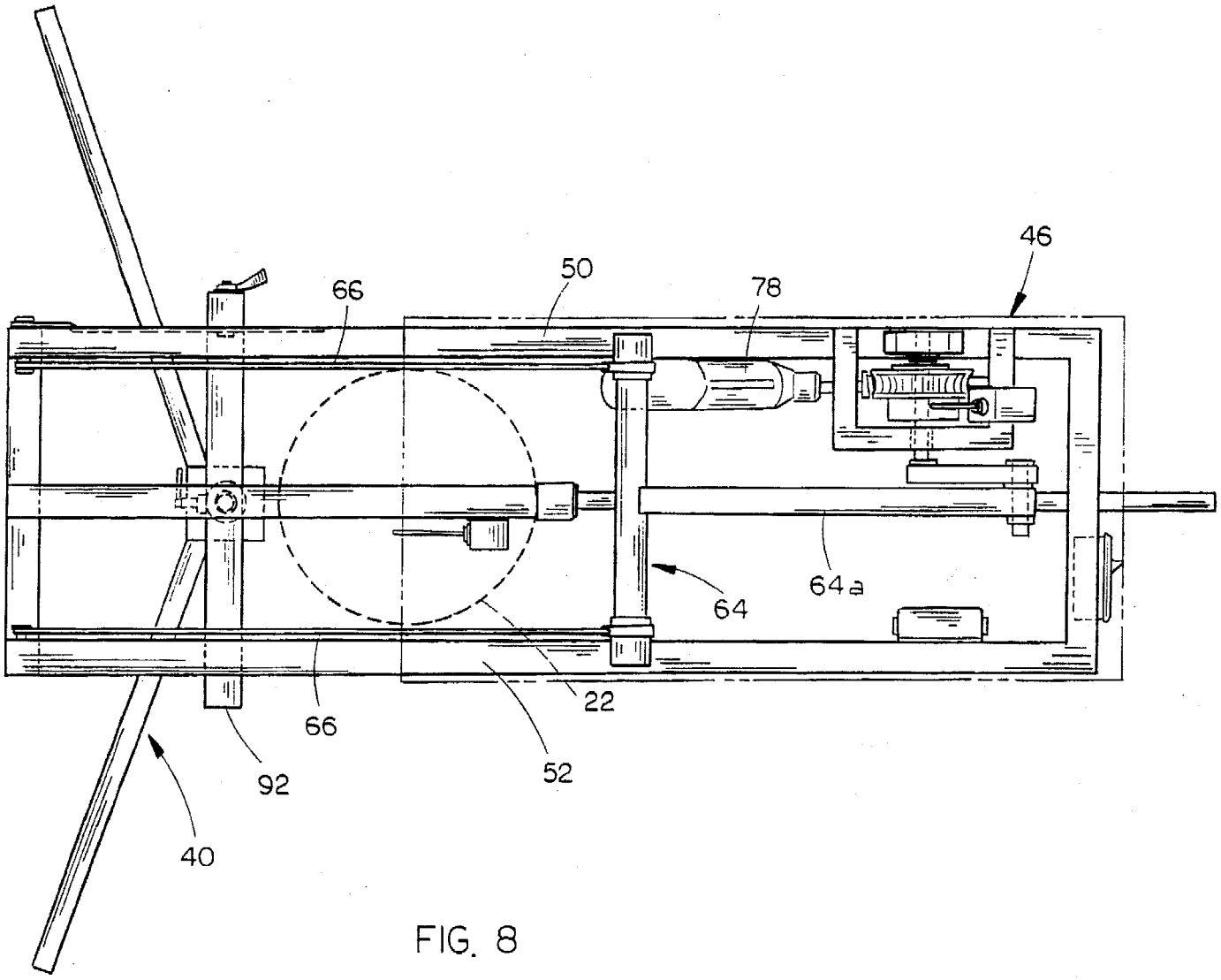
FIG. 8 is a top plan view of the return mechanism, with the cover removed to display the interior.

Referring now to FIGS. 6, 7, and 8, ejector apparatus 46 includes a generally rectangular tubular frame 48 having a pair of longitudinal guide rails 50 and 52, a rearward cross-member 54, and a forward cross-member 56. A pair of short vertical legs 58 depend from the forward ends of guide rails 50 and 52, to support forward cross-member 58 lower than guide rails 50. A ball support rail 60 has a forward end affixed generally centrally on forward cross-member 58, and extends rearwardly therefrom parallel to guide rails 50 and 52, and spaced vertically below the guide rails. A short vertical post 62 projects upwardly from the rearward end of ball support rail 60 to seat a ball 22 in an appropriate position for ejection, as shown in FIG. 7. It can be seen that guide rails 50 and 52 are spaced a distance apart to receive ball 22 therebetween, the ball resting on ball support rail 60.

A T-shaped ejector arm 64 includes a longitudinally extending shaft portion 64*a* and a transversely oriented cross-arm 64*b*. The ends of cross-arm 64*b* have elastic bands 66 looped therearound which extend forwardly for attachment to projecting pins 68 on depending legs 58.

The rearward end of ejector arm shaft 64*a* is pivotally connected to the distal end of a drive arm 70, the proximal end of the drive arm being mounted to a drive gear 72 for rotation therewith. As shown in the drawings, drive arm 70 will rotate on drive gear 72 to cause ejector shaft 64*a* to oscillate forwardly and rearwardly during each cycle of the drive gear.

Drive gear 72 is rotatably mounted in a support structure 74 in operable engagement with a worm 76. The worm 76 is connected to a motor 78 which selectively rotates the worm to thereby rotate drive gear 72 and drive arm 70. Motor 78 includes a clutch which will hold drive arm 70 to stationary once motor 78 has been deactivated. Motor 78 is electrically connected to a power source 80 via electric cord 82.

Two switches 84 and 86 are provided for operating motor 78 and ejecting a ball 22. First switch 84 will stop motor 78 and hold ejector arm 64 in a "cocked" position, once drive arm 70 and drive gear 72 reach a predetermined position sensed by switch 84. Second switch 86 includes a trigger arm 88 which normally projects upwardly into the path of a ball 22 on ball support rail 60. As ball 22 rolls into a seated position against post 62, it will be depress trigger arm 88 thereby activating motor 78 to rotate drive arm 70. As drive arm 70 rotates beyond a position where ejector arm shaft 64*a* is parallel with drive arm 70, elastic bands 66 will quickly pull ejector arm 64 forwardly into contact with ball 22, and eject ball 22 from return mechanism 16. Motor 78 continues to operate and rotate drive arm 70 back to the "cocked" position, wherein first switch 84 stops the motor. Return mechanism 16 is then ready to eject another ball.

A generally cylindrical cover 90 is connected to guide rails 50 and 52 to enclose motor 78 and the rearward end of guide rails 50 and 52. Cover 90 extends forwardly generally midway along guide rails 50 and 52, such that the forwardly projecting ends of guide rails 50 and 52 will receive a ball dropped vertically from above return mechanism 16.

Ejector apparatus 46 is supported on stand 40 by a U-shaped bracket 92 having upwardly projecting legs 92*a* and 92*b* and a base leg 92*c*. The upper ends of bracket legs 92*a* and 92*b* are pivotally connected to guide rails 50 and 52, to support ejector apparatus 46 on bracket 92. An adjustment arm 94 has its forward end pivotally connected to one of legs 58, and its rearward end adjustably connected to a lower end of bracket leg 92*b*. A slot 96 formed along adjustment arm 94 permits the angle at which ejector mechanism 46 is supported to be adjusted by lengthening or shortening the distance between the forward end of adjustment arm 94 and the fastener 98 securing the rearward end of adjustment arm 94 to leg 92*b*.

Referring to FIG. 6, a second motor 100 is mounted to platform 42 on stand 40, and has a drive shaft 102 projecting upwardly from platform 42. Support bracket 92 includes a socket 104 which engages drive shaft 102, and a set screw 106 which is operable to secure bracket 92 to drive shaft 102 for rotation therewith.

Motor 100 is a reversible motor and is electrically connected to a controller 108 for selectively operating the motor in either a forward direction or a rearward direction. Controller 108 includes a receiver therein with an antenna 110 for receiving signals from a remote transmitter 112. Transmitter 112 is operable to transmit signals to operate motor 100 in either a forward or a reverse direction, to thereby aim the ejector apparatus 46 at the desired located on a basketball court.

Whereas the invention has been shown and described in connection with the preferred embodiment thereof, many modifications, substitutions and additions may be made which are within the intended broad scope of the appended claims.

I claim:

1. An automatic ball return apparatus comprising:

a ball retrieval apparatus, for receiving and directing a ball to a predetermined location; and a ball return mechanism located at said predetermined location, for receiving a ball from the retrieval apparatus and ejecting the ball outwardly from the return mechanism, including:

a frame having forward and rearward ends, with a ball receiving portion on the forward end and an ejector mechanism on the rearward end;

said ball receiving portion including the support rail extending rearwardly from the frame forward end, and a pair of spaced apart parallel guide rails extending parallel to the support rail and located on opposing sides of the support rail, the guide rails spaced apart a distance to receive a predetermined diameter ball therebetween;

said ejector mechanism including an ejector arm operably mounted on the frame for longitudinal movement between a rearward "cocked" position and the forward "launch" position;

said ejector arm including a cross arm for contacting and pushing a ball, located rearwardly and adjacent a ball in the ball receiving portion when the ejector arm is in the "cocked" position, and located adjacent the forward end of the ball receiving portion when the ejector arm is in the "launch" position; and means on the frame for selectively and repeatedly moving the ejector arm between the "cocked" and "launch" positions, to thereby eject a ball from the ball return mechanism.

2. The ball return apparatus of claim 1, wherein said means for selectively moving the ejector arm includes a selectively operable motor having a drive arm rotatably connected to the ejector arm to oscillate the ejector arm between the "cocked" and "launch" positions when the motor is operated.

3. The apparatus of claim 2, further comprising biasing means connected to the ejector arm for biasing the ejector arm in a forward direction, said motor overcoming the bias of the biasing means when moving the ejector arm to the "cocked" position.

4. The apparatus of claim 3, wherein said biasing means includes an elastomeric band connected between the forward end of the frame and the ejector arm, said band stretched to an extended condition when the ejector arm is moved to the "cocked" position.

5. The apparatus of claim 4, further comprising a switch on the frame, said switch having an actuator movable between a first position projecting into the path of a ball on the ball receiving portion of the frame, and a second position moved by a ball located on the frame to a deflected position, said switch connected to the motor to operate the motor to cycle the ejector arm between the launch and cocked positions when the switch is in the second, and to stop the motor upon reaching the cocked position when the switch is in the first position.

6. The apparatus of claim 5, further comprising a support stand with ground engaging legs and a platform at an upper end, said ball return mechanism being operably mounted on the platform for selective rotation about a vertical axis, whereby a ball may be ejected at selected positions generally radically outwardly from the vertical rotational axis of the ejector mechanism.

7. The apparatus of claim 6, further comprising an operable motor mounted on the stand with a drive shaft connected to the ejector mechanism for rotating the ejector mechanism upon actuation of the motor.

8. The apparatus of claim 7, wherein the stand motor is reversible, to selectively rotate the ejector mechanism in either a clockwise or counterclockwise direction.

9. The apparatus of claim 8, further comprising an electrical control unit connected to the stand motor, operable to electrically activate the stand motor in either direction.

10. The apparatus of claim 9, further comprising a receiver in the control unit, electrically connected thereto to operate the stand motor in a first direction upon receiving a first signal and to operate the stand motor in a second direction upon receiving a second signal, and a transmitter remote from the control unit, including a first switch for transmitting the first signal, and a second switch for transmitting the second signal.

11. The apparatus of claim 9, further comprising a support frame for supporting the ball return mechanism on the stand, said ball return mechanism pivotally connected to the support frame for selective pivotal movement about a generally horizontal pivot axis, the pivot axis oriented generally orthogonal to the support and guide rails.

12. The apparatus of claim 11, wherein said support frame includes a bracket mounted on the stand motor drive shaft, for rotation therewith, and further includes an adjustment arm adjustably connected between the bracket and the ball return mechanism frame, for selectively fixing the angle of elevation of the ball return mechanism relative to horizontal.

13. The apparatus of claim 1, further comprising a support stand with ground engaging legs and a platform at an upper end, said ball return mechanism being operably mounted on the platform for selective rotation about a vertical axis, whereby a ball may be ejected at selected positions generally radically outwardly from the vertical rotational axis of the ejector mechanism.

14. The apparatus of claim 13, further comprising an operable motor mounted on the stand with a drive shaft connected to the ejector mechanism for rotating the ejector mechanism upon actuation of the motor.

15. The apparatus of claim 14, wherein the stand motor is reversible, to selectively rotate the ejector mechanism in either a clockwise or counterclockwise direction.

16. The apparatus of claim 15, further comprising an electrical control unit connected to the stand motor, operable to electrically activate the stand motor in either direction.

17. The apparatus of claim 16, further comprising a receiver in the control unit, electrically connected thereto to operate the stand motor in a first direction upon receiving a first signal and to operate the stand motor in a second direction upon receiving a second signal, and a transmitter remote from the control unit, including a first switch for transmitting the first signal, and a second switch for transmitting the second signal.

18. The apparatus of claim 17, further comprising a support frame for supporting the ball return mechanism on the stand, said ball return mechanism pivotally connected to the support frame for selective pivotal movement about a generally horizontal pivot axis, the pivot axis oriented generally orthogonal to the support and guide rails.

19. The apparatus of claim 1, further comprising a support frame for supporting the ball return mechanism on the stand, said ball return mechanism pivotally connected to the support frame for selective pivotal movement about a generally horizontal pivot axis, the pivot axis oriented generally orthogonal to the support and guide rails.

20. The apparatus of claim 19, wherein said support frame includes a bracket mounted on the stand motor drive shaft, for rotation therewith, and further includes an adjustment arm adjustably connected between the bracket and the ball return mechanism frame, for selectively fixing the angle of elevation of the ball return mechanism relative to horizontal.

* * * * *